US007147227B2

(12) United States Patent
Taghavi

(10) Patent No.: US 7,147,227 B2
(45) Date of Patent: Dec. 12, 2006

(54) METHOD OF PLAYING A CARD GAME

(76) Inventor: Seyedfarid Taghavi, 15-24 College Point Blvd., Apt. 2R, College Point, NY (US) 11356

( * ) Notice: Subject to any disclaimer, the term of this patent is extended or adjusted under 35 U.S.C. 154(b) by 0 days.

(21) Appl. No.: 10/881,834

(22) Filed: Jun. 30, 2004

(65) Prior Publication Data

US 2006/0001215 A1 Jan. 5, 2006

(51) Int. Cl.
*A63F 1/00* (2006.01)

(52) U.S. Cl. ..... 273/292; 463/13

(58) Field of Classification Search ..... 273/292, 273/274, 309; 463/12, 13
See application file for complete search history.

(56) References Cited

U.S. PATENT DOCUMENTS 5,678,821 A * 10/1997 Hedman ..... 273/292
5,810,663 A * 9/1998 Bochichio et al. ..... 463/13
5,882,260 A 3/1999 Marks
6,733,012 B1 5/2004 Bui et al.
6,749,501 B1 6/2004 Crawford
2002/0113371 A1* 8/2002 Snow ..... 273/292
2003/0094761 A1* 5/2003 Furuta et al. ..... 273/292

* cited by examiner

*Primary Examiner*—Benjamin Layno
(74) *Attorney, Agent, or Firm*—Ostrolenk, Faber, Gerb & Soffen, LLP

(57) ABSTRACT

A method of playing a card game is disclosed. A low hand bet and a high hand bet, is received from a player. One card is dealt faced down to each player, which card can be viewed by only a respective player to which it is dealt. Four additional cards are dealt to each player face down and not to be looked at by the player. The low hand is played by permitting a player to play his first card on either the low hand or only on the high hand. The dealer needs to have an eight or less to qualify for playing the low hand. However, if a player plays a nine or higher on the low hand, the dealer does not need the qualifier. The low hand card of each player is then compared with the low hand card of the dealer. If a player's low hand card is lower than the dealer's low hand card, the player wins his low hand bet. The four additional cards are turned over and combined with the low hand card. The best possible poker hand combination of the player's cards are compared with the best possible poker hand combination of the dealer's cards to determine if the player or the dealer has a better poker hand.

20 Claims, 2 Drawing Sheets

METHOD OF PLAYING A CARD GAME

BACKGROUND OF THE INVENTION

The present invention relates to card games, and more particularly to a system and method of playing a card game based upon poker with multiple wager options.

Most card games typically involve dealing each player an original hand of cards. This original hand is evaluated in accordance with game rules.

For an example, in a basic poker game, which is played with a standard 52-card deck, each player is dealt five cards. All five cards in each player's hand are evaluated as a single hand with the presence of various combinations of the cards such as pairs, three-of-a-kind, straight, etc. Determining which combinations prevail over other combinations is done by reference to a table containing a ranking of the combinations. Rankings in most tables are based on the odds of each combination occurring in the player's hand. Regardless of the number of cards in a player's hand, the values assigned to the cards, and the odds, the method of evaluating all five cards in a player's hand remain the same. In a modified poker card game as described in U.S. Pat. No. 5,882,260 in which each player has more than five cards in hand. Each player builds at least two five-card hands that are placed on a playing surface enjoined by an intersecting card to define a pattern. This method has the disadvantage of requiring each player to be dealt at least nine cards at a time. Because all cards are placed on the playing surface in a pattern, a substantial amount of space in the playing surface is required for each player.

Other types of poker games also exist with various types of rules. The problem with most of these games is that they either require a great deal of concentration to follow the cards being handed out and they also have a limited possibility of placing wagers, namely wagering can only be done as the game progresses and the cards are handed out. The problem with these types of games is that novice or less experienced players do not feel comfortable playing the games because they do not necessarily know the rankings of the various combinations.

Presently, Black Jack, Baccarat, "Let it Ride" and Poker Paigow are among the more popular card games played at casinos. Each of these games, however, has various negative aspects which detract from the game. For example, in Black Jack any mistakes made by a player can change the outcome of the game. Furthermore, mistakes made by other players can affect the outcome of a player's hand. Furthermore, in conventional Black Jack, it is not possible to obtain a large return on a bet, such as, for example, a hundred or more times the bet. Baccarat has the disadvantage that the player is not permitted to touch the cards, which detracts from the player's interest. Furthermore, there is no decision making needed in the game once a bet is placed. Thus, Baccarat is very much a spectator game. Furthermore, Baccarat does not provide for extremely large returns on a wager. The down side of the "Let it Ride" game is that the odds for the player are not very attractive. Finally, Poker Paigow is a very slow moving game that involves a high number of pushes. This takes away from the excitement being sought by the player, which excitement results from active play and frequent opportunities to win.

SUMMARY OF THE INVENTION

Accordingly, it is an object of the present invention to provide a method of playing a card game which overcomes the problems mentioned above and is attractive to players at all skill levels.

Pursuant to this object, and others which will become apparent hereafter, one aspect of the present invention resides in a game in which up to three wagers can be made and two hands are played per deal.

Although the game will be described as being played live at a gaming table, it is within the ambit of the present invention that the play of the card game can be implemented electronically, such as on an electronic gaming machine, a portable handheld device, a stand-alone game machine, a personal computer, and other devices that are commercially available and known to those skilled in the art.

Other features and advantages of the present invention will become apparent from the following description of the invention which refers to the accompanying drawings.

DETAILED DESCRIPTION OF THE INVENTION

Figure 2:
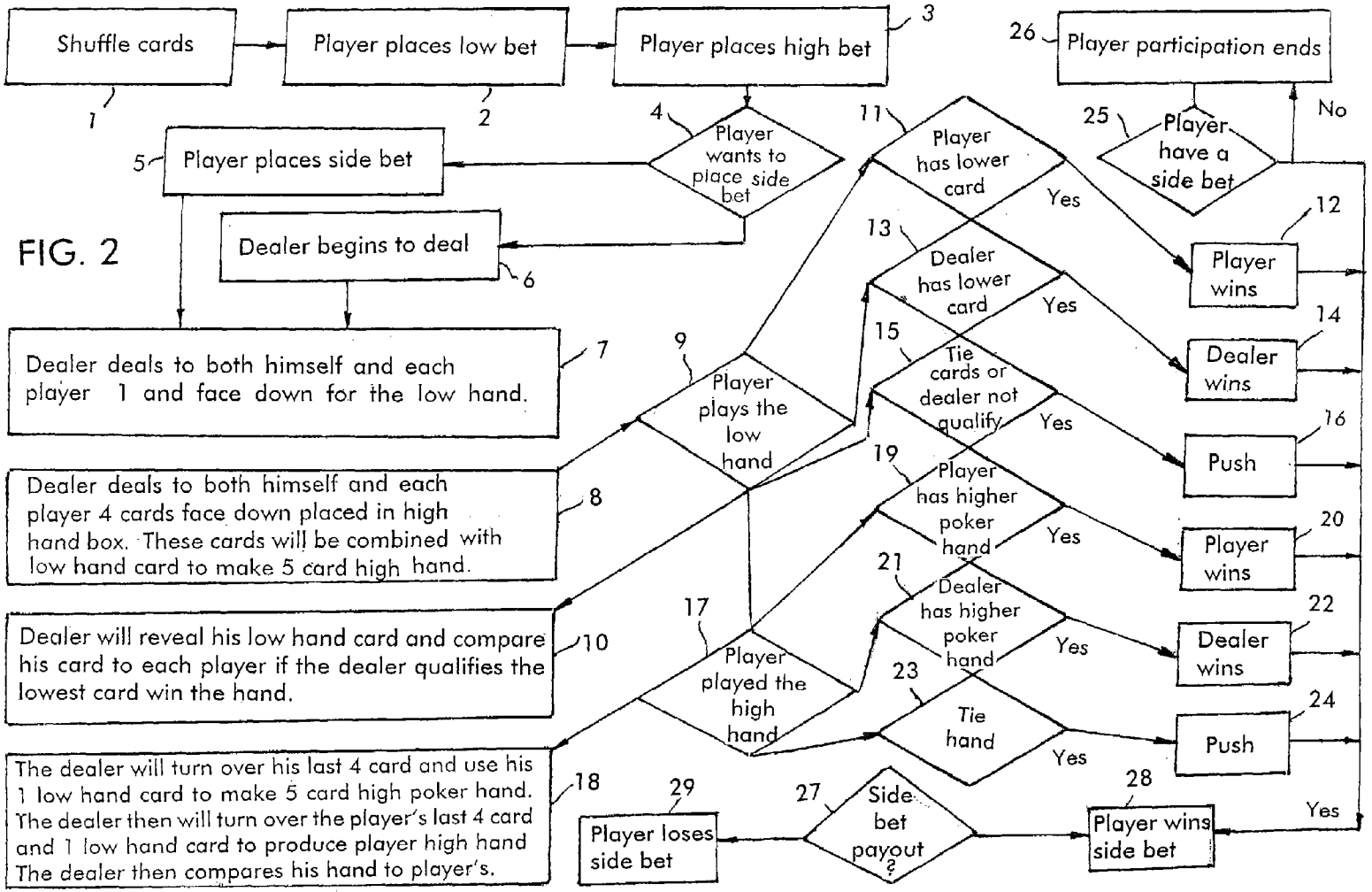

FIG. 2 is a flow diagram illustrating the play of the game according to the invention.

The present invention is a modification of a five-card poker game.

The game is played with a standard deck of playing cards. Referring to FIG. 2, a dealer deals the cards and up to nine players can play the game at one time if five cards are played per player, or six players can play if seven cards are played per player.

To begin the game, each player must place two bets, namely the low bet and a high bet. The high bet must be at least equal to the amount of the low bet and is preferably twice the low bet. An optional third ante bet is also possible. Ante bets are well-known wagers in casino card games. Players would not be allowed to make the optional ante bet without playing the main game. The ante bet is a windfall wager which pays out for certain ranked hands. For example, a royal flush can pay one thousand times the ante, a straight flush two hundred times the ante, a four-of-a-kind one hundred times the ante, a full house twenty-five the ante, a flush fifteen times the ante, a straight eight times the ante, three-of-a-kind five times the ante, two pairs one times the ante. These bonus multiples are only examples and can be any amount desired by the gaming establishment.

As previously stated, the high bet must be at least equal to, and in the described embodiment twice, the amount of the low bet. For example, if the table minimum is one dollar, the high bet would have to be two dollars, if the minimum is two dollars, the high bet would have to be four dollars, etc. After placing bets, each player receives one card faced down that the player can look at. This first card cannot, however, be shown to the other players. The first card is the "low hand."

Each player then receives four additional cards faced down. The four cards are placed in the "riding high" box which is designated R.HIGH in the drawing. The players are not allowed to touch these cards until the low hand is played. The dealer also receives a low hand and four cards in his "riding high" box, just as the players do.

Figure 1:
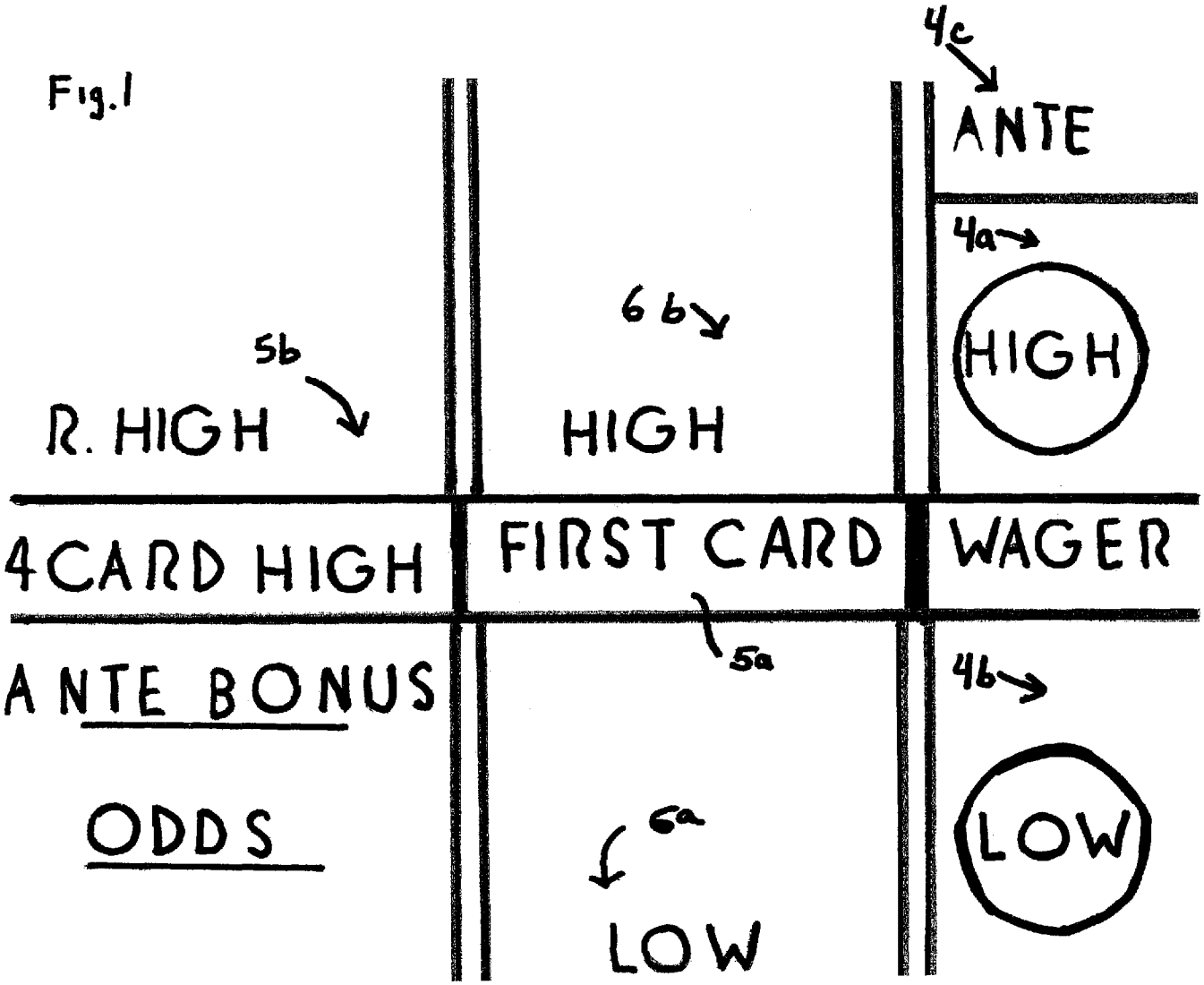
FIG. 1 is a top view of the game surface or screen display of the present invention illustrating the game layout.

The dealer also deals himself a first card and four additional cards. The player decides whether to play their first card as a low or high card and places the card faced up in either the low or high position shown in FIG. 1. In order for the dealer to qualify, his first card must be an eight or less. However, if any player plays a nine or higher on the low hand, the dealer does not need a qualifier for that player and the lowest card simply wins.

Each player must play at least one hand either high or low, and the ante does not qualify as a hand. If the player plays the low hand and loses, he loses his low wager and gets his high wager back.

If the player plays the low hand and wins, he has the option of adding his winnings, or any portion of his original bet, to the high wager. The player also has the option of taking the low bets and/or winnings off the table after the low hand is played.

If the player plays the low hand card and loses, and if he does not have an ante bet, his cards are collected and none of the players get to see any of the additional four cards he was dealt.

If a push results on the low hand, the player has the option of leaving his low and high bets on the table to play the high hand or taking the low bet back and playing only the high bet with the high hand. It is also possible, to increase revenue for the casino, to have a house rule that a push in the low hand results in a win for the house.

If the player plays the high hand with his first card, he gets the low bet back. If the player does play the high hand with the first card without playing the low hand, the winner is determined between the house or dealer and the player according to who has the better poker hand from a combination of all five cards pursuant to the standard hand rankings of poker.

Once the low hand is finished, the dealer or each player will turn over the high cards. The dealer then looks at each player's hand to determine if a player's hand is higher than the dealer's hand. If a player's hand is higher, the player wins.

As previously stated, if a player played only the low hand and not the high hand and did not play an ante, his cards are taken without being shown. If a player played the low hand and not the high hand but did place an ante wager, his cards get turned over last. If all the players played only the low hand and not the high or the ante, the dealer retrieves all the high hand cards without turning them over. If a player has made an ante wager without a high hand, his high hand cards will not be retrieved by the dealer and instead will be turned over after the high hand has been completed with the other players, in order to determine if the player wins on his ante wager.

The dealer handles each player separately for each hand. For example, the dealer starts with the player on the left to determine if the player has won the low hand. Once completed with this player, the dealer moves to the next player to determine who won the low hand. This continues until the low hand is finished for all of the players. Then the dealer can either have the players all turn over their cards simultaneously or can also address each player individually for the high hand to determine if the player has won or lost.

The beauty of the present game is that it does not require the players to have any skill in playing poker. Each player only plays against the dealer and does not need to make any decisions relative to the cards since the cards are dealt by the dealer and simply turned over to see if the player has any good combinations.

Furthermore, the game provides the excitement of allowing the winner of the low hand to increase his high hand bet if he desires. Additionally, the ante bet allows the possibility of a windfall bonus of an amount which would not normally be obtainable in a card game with a small bet.

Although the game has been described as being played at a table with a live dealer, the game is easily adaptable to play electronically on a video monitor.

Although the present invention has been described in relation to particular embodiments thereof, many other variations and modifications and other uses will become apparent to those skilled in the art. It is preferred, therefore, that the present invention be limited not by the specific disclosure herein, but only by the appended claims.

What is claimed is:

1. A method of playing a card game between at least one player and a dealer, the card game having a deck of cards and rules of play, comprising the steps of:

receiving at least two bets from a player, the bets including a low hand bet and a high hand bet, the high hand bet being at least equal to the low hand bet;

dealing only one first card faced down to each player, which card can be viewed by only a respective player to which it is dealt;

dealing only one first card facedown to a dealer dealing at least four additional cards to each player face down and not to be looked at by the player until the low hand bet has been resolved;

dealing at least four additional cards to the dealer face down and not to be looked at by the player until the low hand bet has been resolved;

playing the low hand including permitting a player to play his first card on either the low hand or only on the high hand, the dealer's first card must be an eight or less to qualify for playing the low hand, however, if a player's first card is a nine or higher on the low hand, the dealer's first card does not need to qualify, the low hand card of each player is then compared with the low hand card of the dealer, if a player's low hand card is lower than the dealer's low hand card, the player wins his low hand bet;

after the dealer has completed the low hand with each player, each player's four additional cards and the dealer's four additional cards are turned over and combined with the low hand card and the dealer's low handcard, respectively;

the dealer then progresses through each player and compares a best possible poker hand combination of the player's cards with the best possible poker hand combination of the dealer's cards to determine if the player has a better poker hand, the winner wins an amount equal to the high wager, the dealer then progresses through any of the remaining players in a similar fashion.

2. The method of claim 1, wherein if the player plays the low hand and loses, his high hand is returned.

3. The method of claim 1, wherein if the player wins the low hand, he has the option of moving some or all of his winnings or original bets to the high hand.

4. The method of claim 1, and further including placing an additional ante wager at the player's option, and paying off on the ante wager if the player has a hand matching a hand from a predetermined list, the pay off being an amount that is a multiple of the ante wager.

5. The method of claim 4, wherein if the player plays the low hand and loses and has made no ante wager, his additional four cards are collected without being shown.

6. The method of claim 4, wherein payout multiples of the ante are predetermined.

7. The method of claim 4, wherein if a player has made an ante wager and is playing both the low and high hands, any payment on the ante wager is made after completion of both the low and high hands.

8. The method of claim 4, wherein if all players are playing only the low hand and not the high hand, and no ante wager was made, the additional cards are never turned over.

9. The method of claim 1, wherein if the low hand results in a push, the player has an option of taking back the low hand wager or adding the low hand wager to the high hand wager.

10. The method of claim 1, wherein if a push results in the low hand, the dealer wins.

11. The method of claim 1, wherein if the player plays the first card as the high hand, the dealer returns the low hand wager to the player.

12. The method of claim 1, wherein standard poker rules are used to determine the best hand.

13. The method of claim 1, wherein the dealer turns the cards of the high hand.

14. The method of claim 1, wherein the player turns the cards of the high hand.

15. The method of claim 1, including utilizing a gaming surface having a plurality of areas including a respective area for each of the low wager, the high wager, the ante wager, first card low hand, first card high hand and for the additional four high hand cards.

16. The method of claim 15, wherein the areas also include an area which indicates ante bonus odds.

17. The method of claim 1, wherein the high hand bet is twice the low hand bet.

18. The method of claim 1, including dealing six additional cards to each player.

19. The method according to claim 1, wherein each player is required to play the low hand.

20. The method according to claim 1, wherein if the player plays the low hand and loses, he has the option of playing the high hand or not playing the high hand.

* * * * *